US006648060B1

(12) United States Patent
Yang

(10) Patent No.: US 6,648,060 B1
(45) Date of Patent: Nov. 18, 2003

(54) REINFORCED SHELL MOLD AND METHOD

(75) Inventor: Xi Yang, Muskegon, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 10/147,288

(22) Filed: May 15, 2002

(51) Int. Cl.[7] ..... B22C 1/02; B22C 9/04
(52) U.S. Cl. ..... 164/519; 164/361
(58) Field of Search ..... 164/516, 517, 164/518, 519, 361

(56) References Cited

U.S. PATENT DOCUMENTS

| | | | | |
|---|---|---|---|---|
| 3,754,946 A | * | 8/1973 | Moore, Jr. | 106/38.35 |
| 4,196,769 A | * | 4/1980 | Feagin | 164/518 |
| 4,624,898 A | | 11/1986 | Moore et al. | 428/446 |
| 4,927,673 A | | 5/1990 | Buntrock et al. | 427/376.2 |
| 4,966,225 A | | 10/1990 | Johnson et al. | 164/519 |
| 5,297,615 A | | 3/1994 | Aimone et al. | 164/519 |
| 5,310,476 A | | 5/1994 | Sekhar et al. | 205/230 |
| 5,335,717 A | | 8/1994 | Chin et al. | 164/519 |
| 5,407,001 A | | 4/1995 | Yasrebi et al. | 164/519 |
| 5,629,369 A | | 5/1997 | Guerra, Jr. | 524/493 |
| 5,766,686 A | | 6/1998 | Perich et al. | 427/314 |
| 5,927,379 A | | 7/1999 | Yasrebi et al. | 164/518 |
| 5,944,088 A | | 8/1999 | Feagin | 164/369 |
| 5,975,188 A | | 11/1999 | Lassow et al. | 164/76.1 |
| 6,000,457 A | | 12/1999 | Vandermeer | 164/518 |
| 6,352,101 B1 | * | 3/2002 | Ghosh et al. | 164/516 |

FOREIGN PATENT DOCUMENTS

| | | | |
|---|---|---|---|
| WO | WO 01/45876 | * | 6/2001 |
| WO | WO 02/38308 | * | 5/2002 |

* cited by examiner

*Primary Examiner*—Kuang Y. Lin

(57) ABSTRACT

A method of making a ceramic shell mold comprises repeatedly coating a fugitive pattern of an article to be cast with a ceramic slurry layer and applying on the ceramic slurry layer a refractory stucco to form a plurality of ceramic slurry layers and stucco layers on the pattern wherein at least one of the stucco layers is formed by applying discontinuous stucco fibers followed by applying a granular stucco particles on the discontinuous stucco fibers.

7 Claims, 5 Drawing Sheets

REINFORCED SHELL MOLD AND METHOD

FIELD OF THE INVENTION

The present invention relates to ceramic investment shell molds for casting molten metals and alloys and, more particularly, to ceramic shell molds that are fiber reinforced to improve mold strength at high casting temperatures.

BACKGROUND OF THE INVENTION

Both the investment casting process and the lost wax shell mold building process are well known, for example, as is apparent from the Operhall U.S. Pat. Nos. 3,196,506 and 2,961,751. The lost wax shell-mold building process involves repeatedly dipping a wax or other fugitive pattern of the article to be cast in ceramic slurry to provide a ceramic slurry layer, draining excess slurry, stuccoing the slurry with coarse ceramic particles to provide a stucco layer on the slurry layer, and drying the layers to build up a shell mold of desired wall thickness on the pattern. The green shell mold/pattern assembly then is subjected to a pattern removal operation to selectively remove the pattern from the shell mold. A commonly used wax pattern removal technique involves flash dewaxing where the green shell mold/pattern assembly is placed in an oven at elevated temperature to rapidly melt the wax pattern from the green shell mold. Following pattern removal, the green shell mold is fired at elevated temperature to develop mold strength for casting of molten metal or alloy therein.

Conventional lost wax ceramic shell molds can be prone to mold cracking or splitting during the pattern removal operation described above.

Attempts have been made to raise the capability of ceramic shell molds in the DS casting of superalloy components. For example, U.S. Reissue Pat. No. 34,702 describes in one illustrative embodiment wrapping alumina-based or mullite-based reinforcement fiber in a continuous spiral about an intermediate mold wall thickness as it is being built-up. U.S. Pat. No. 6,364,000 discloses in one illustrative embodiment positioning one or more continuous carbon-based reinforcement fibers in a ceramic shell mold wall to this end.

SUMMARY OF THE INVENTION

The present invention involves a method of making a ceramic shell mold comprising repeatedly coating a fugitive pattern of an article to be cast with a ceramic slurry layer and applying on the ceramic slurry layer a refractory stucco to form a plurality of ceramic slurry layers and stucco layers on the pattern wherein at least one of the stucco layers is formed by applying discontinuous stucco fibers followed by applying a granular stucco particles on the discontinuous stucco fibers.

In a preferred embodiment of the invention, the granular stucco particles are applied on randomly oriented discontinuous stucco fibers to pack the discontinuous stucco fibers down on the slurry layer underlying the discontinuous fibers. The granular stucco particles preferably are applied on the discontinuous stucco fibers while the underlying slurry layer is still wet such that a majority of the packed down discontinuous stucco fibers stick to the slurry layer. The granular stucco particles preferably are applied on the randomly oriented discontinuous stucco fibers to form a stucco layer comprising a mat of the discontinuous stucco fibers and the granular stucco on and in the mat.

In an illustrative embodiment offered to illustrate but not limit the invention, the granular stucco particles are applied by raining the granular stucco particles by gravity down on the discontinuous stucco fibers.

The present invention also provides a ceramic shell mold wherein at least one of the stucco layers comprises the discontinuous stucco fibers and the granular stucco particles.

Shell molds pursuant to the invention are advantageous to resist mold splitting during the pattern removal operation.

The present invention will become more readily apparent from the following detailed description.

DETAILED DESCRIPTION OF THE INVENTION

Figure 1:
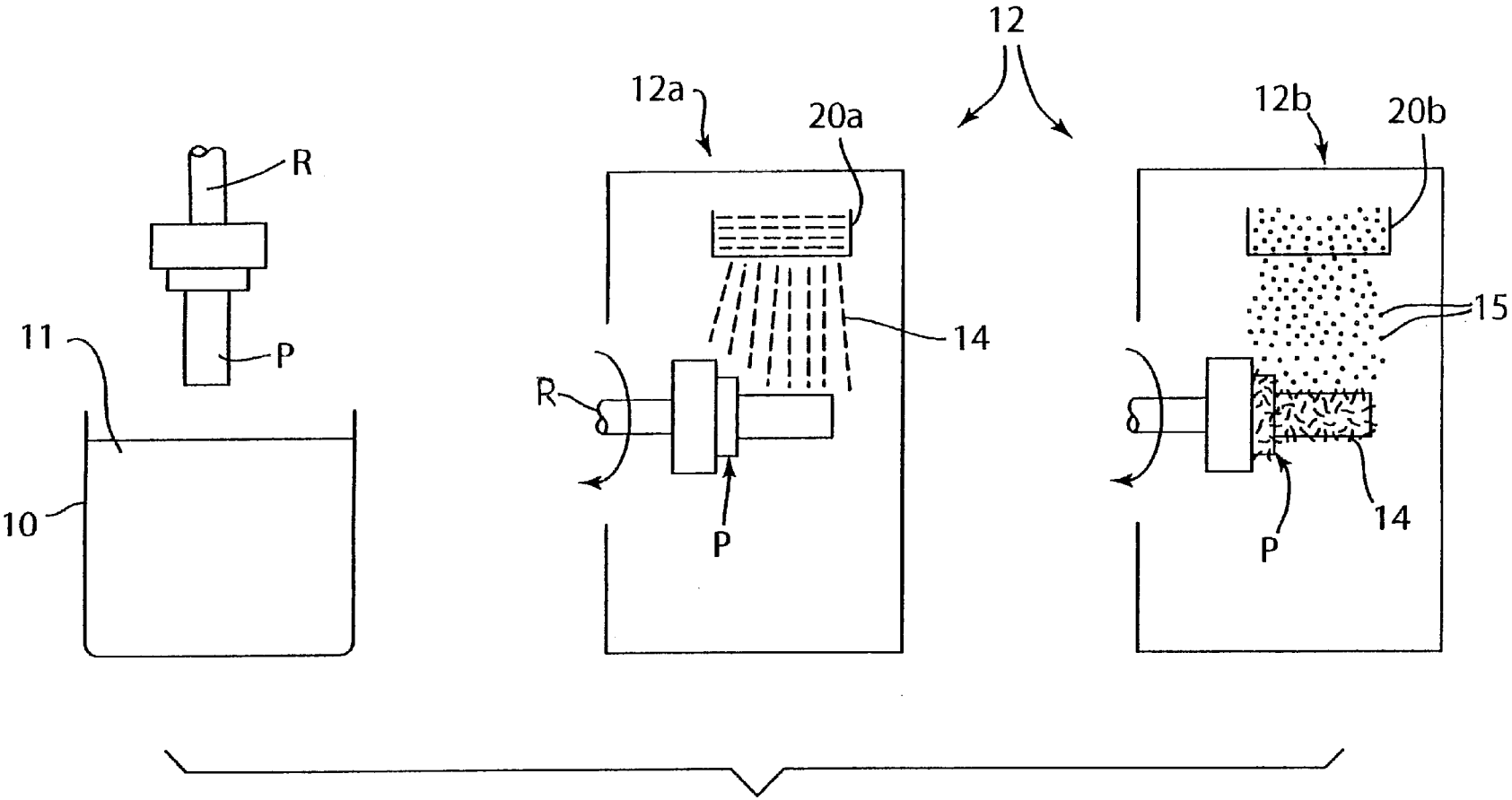
FIG. 1 is a schematic diagram of a method of making a investment shell mold pursuant to an illustrative embodiment of the invention.

FIG. 1 illustrates schematically a lost wax ceramic shell mold building process to which the invention is applicable where a ceramic shell mold is formed by repeatedly coating a fugitive pattern of the article cast with refractory flour slurry (i.e. ceramic flour in a liquid binder) to provide a slurry layer, draining excess slurry, stuccoing the slurry layer with refractory stucco to provide a stucco layer on the slurry layer until a desired shell mold wall thickness is built up. The fugitive pattern can comprise a conventional wax, wax/polymer blends, polymeric or other fugitive materials molded or otherwise formed to the shape of the article to be cast as is well known in the art. Such fugitive patterns are removable from the green shell mold invested thereabout using conventional pattern removal techniques such as melting, leaching and/or vaporizing the pattern therefrom.

In FIG. 1, the pattern P is dipped in the refractory flour (e.g. ceramic powder) slurry 11 held in a vessel 10, drained of excess refractory slurry by temporary holding the pattern above the vessel 10 for a predetermined time, and then is stuccoed at a stucco-applying station 12 while the refractory slurry layer is still wet. The pattern P typically is moved by a robot arm R. In practice of an illustrative embodiment of the invention, the stucco-applying station 12 comprises a fiber stucco-applying apparatus 12*a* for applying discontinuous stucco fibers 14 to the pattern and a granular stucco-applying apparatus 12*b* for applying granular stucco particles 15 to form at least one of the stucco layers to comprise both discontinuous stucco fibers and granular stucco fibers pursuant to the invention. Other stucco layers may comprise only granular stucco particles, which are applied to the pattern at only the granular stucco-applying apparatus 12*b*. That is, the fiber stucco-applying apparatus 12*a* is not used when the stucco layer comprises only granular stucco particles. The stucco applying apparatus 12*a*, 12*b* can comprise conventional stucco towers having a bin 20*a*, 20*b* respectively, in which discontinuous stucco fibers and granular stucco particles reside, respectively.

The pattern P with the stuccoed refractory slurry layer then is dried in air or in a conventional drying apparatus. After drying, the pattern P is subjected to similar dipping, draining, stuccoing and drying operations until the desired shell mold wall thickness is built up on the pattern. Drying of ceramic slurry/stucco layers is described in U.S. Pat. Nos. 2,932,864; 4,114,285; and others as well as U.S. Ser. No. 09/690,144 of common assignee herewith.

Typically, in practicing the lost wax process, one or more so-called prime coat (refractory slurry) layers and prime coat stucco layers are applied to the pattern initially to provide a facecoat for contacting the molten metal or alloy to be cast in the shell mold. Then, the facecoated pattern is subjected to repeated steps of slurry dipping, draining, stuccoing and drying steps to form back-up slurry layer/stucco layers on the prime coat slurry layer(s) until the desired shell mold wall thickness is built-up. In general, the prime coat(s) employ(s) a finer refractory flour in the slurry than that present in the back-up slurries. The prime coat stucco similarly is a less coarse stucco than the back-up stucco. The prime coat slurry/stucco typically comprise a respective refractory material, such as a ceramic, to form a facecoat suitably for contacting the molten metal or alloy being cast without adverse reaction therewith. The back-up slurry and back-up stucco can comprise a refractory flour and refractory stucco which may be different or the same as those used for the prime coat slurry/stucco. The refractory flours/stuccoes used in the shell mold layers for casting nickel base and cobalt base superalloys typically comprise ceramic flours/stucco as described in U.S. Pat. Nos. 4,966,225, 5,335,717, 5,975,188 and others, although refractory materials such as graphite, nitrides, carbides, and other materials may be used as described for example in U.S. Pat. No. 5,297,615, the teachings of all of these patents being incorporated herein by reference.

The present invention involves forming at least one, preferably a plurality, of the stucco layers of the shell mold by applying discontinuous stucco fibers followed by applying granular stucco particles on the discontinuous stucco fibers. For example, in an embodiment of the invention offered for purposes of illustration and not limitation, the granular stucco particles 15, FIG. 1, are applied at apparatus 12*b* on the discontinuous stucco fibers 14 previously applied at apparatus 12*a*, FIG. 1, to impact and pack the initially randomly oriented discontinuous stucco fibers 14, FIG. 2A, down on the slurry layer underlying the discontinuous fibers. The granular stucco particles 15 preferably are applied on the discontinuous stucco fibers 14 while the underlying slurry layer is still wet such that a majority, preferably greater than 75% and more preferably 80–90%, of the discontinuous stucco fibers 14 are packed down and stick to the slurry layer as a result of impact by the falling granular stucco particles 15. The granular stucco particles preferably are applied on the randomly oriented discontinuous stucco fibers to form a stucco layer comprising a generally two dimensional mat of packed down discontinuous stucco fibers 14 and the granular stucco particles on and in the mat, FIG. 2B, where the granular stucco particles are represented by dots in FIG. 2B.

The discontinuous stucco fibers can comprise silica, alumina, or other refractory materials suitable for the particular mold being formed and the particular casting parameters to be used. The stucco fibers are discontinuous, relatively short fiber lengths having a length greater than fiber diameter. The stucco fibers preferably have lengths not exceeding ½ inch, typically in the range of ¼ to ⅜ inch, for purposes of illustration only and fiber aspect ratios (length to diameter ratio) in the range of 10 to 100, although the invention is not limited to these ranges. The granular stucco particles are characterized as having a blocky grain morphology and aspect ratio less than 2, a particle shape typical of granular stuccoes used heretofore in the lost wax shell mold process and described in the above cited U.S. Patents. The granular stucco particles can comprise silica, alumina or other suitable refractory stucco materials suitable for the particular mold being formed and the particular casting parameters to be used. The discontinuous stucco fibers and the granular stucco particles comprise the same or different refractory or ceramic material.

Figure 2A:
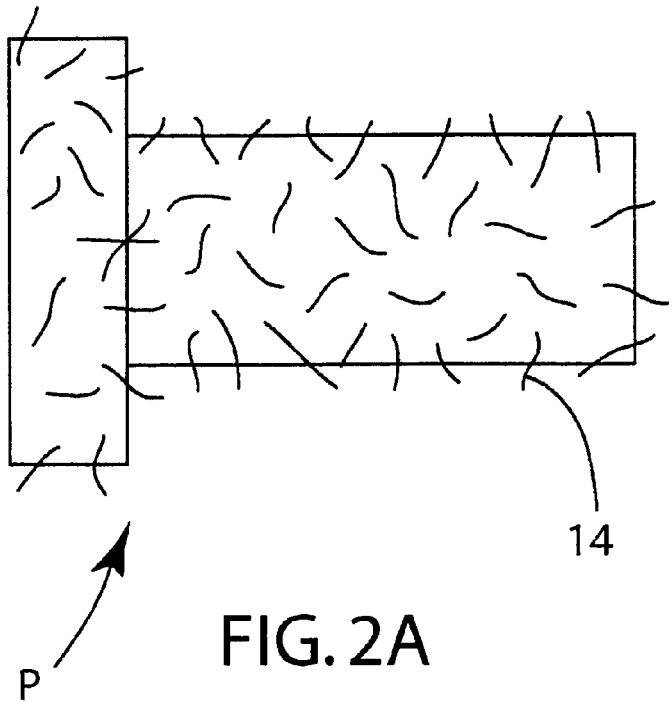
FIG. 2A is a schematic partial view of a shell mold wall on the pattern showing the randomly oriented discontinuous stucco fibers applied on a still wet refractory slurry layer before the stucco fibers are packed down to form a generally two dimensional mat.

The stucco applying apparatus 12*a*, 12*b* can comprise conventional stucco towers having an elevated bin 20*a*, 20*b*, respectively, in which discontinuous stucco fibers 14 and granular stucco particles 15 reside, respectively. At apparatus 12*a*, the discontinuous stucco fibers 14 are released from the bin 20*a* to fall or rain down by gravity on the wet refractory layer on the pattern P, which is disposed a preselected distance (e.g. 20 to 60 inches) below the bin 20*a* and rotated so that the stucco fibers will impact and cover the entire surface area of the wet refractory slurry layer. Typically, the discontinuous stucco fibers 14 are released from bin 20*a* until stucco fibers are observed to fall off of (not stick to) the pattern as a result of its being completely covered by previously released stucco fibers 14, although a predetermined amount of stucco fibers can be released over time. The discontinuous stucco fibers 14 stick to the wet slurry layer in a three dimensional array of randomly oriented fibers 14 as illustrated in FIG. 2A. At apparatus 12*b*, the granular stucco particles 15 are released from the bin 20*b* to fall or rain down by gravity on the fiber-stuccoed, still wet refractory layer on the pattern P disposed a preselected distance (e.g. 20–60 inches) below the bin 20*b* and rotated so that the granular stucco particles impact the stucco fibers and pack them down on the still wet refractory slurry layer. Typically, the granular stucco particles 15 are released from bin 20*b* until stucco particles are observed to fall off of (not stick to) the pattern as a result of its being completely covered by previously released granular stucco particles 15, although a predetermined amount of granular stucco particles can be released over time. Any conventional stucco tower can be used in practicing the invention. A particular stucco tower which can be used to practice the invention is described in U.S. Ser. No. 09/690,144 filed Jul. 27, 2000, of common assignee herewith, the teachings of which are incorporated herein by reference.

The fiber stucco or granular stucco particles can be applied to the pattern by other means including spray coating, fluidized bed coating or other techniques which provide sufficient energy to the stucco particles to pack down the stucco fibers to form a two dimensional mat type structure on the pattern.

The one or more stucco layers formed pursuant to the invention by applying discontinuous stucco fibers 14 followed by applying a granular stucco particles 15 on the randomly oriented discontinuous stucco fibers can preferably comprise intermediate stucco layers of shell mold wall 25, although the invention is not limited in this regard. For example, for purposes of illustration and not limitation, the stucco layer comprising the discontinuous stucco fibers 14 and granular stucco particles 15 can comprise the 4th, 5th, 6th, etc. intermediate stucco layers of the shell mold wall as it is being built-up layer-by-layer.

Figure 2B:
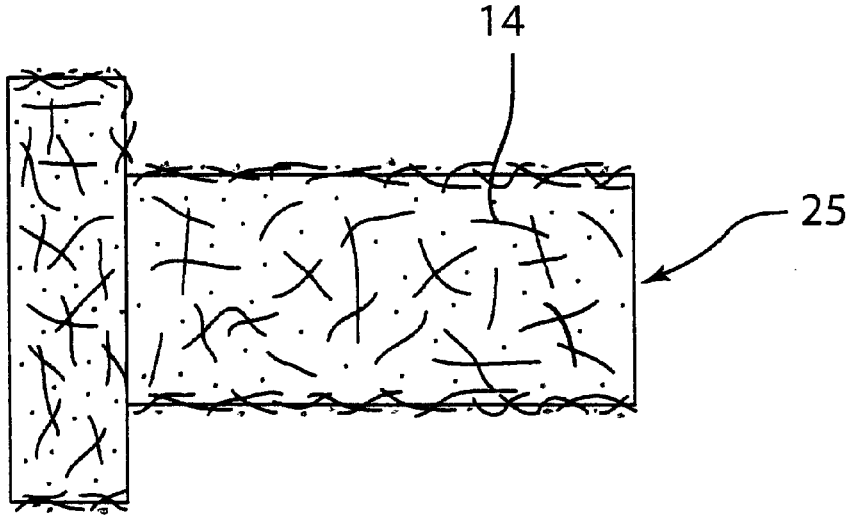
FIG. 2B is a schematic partial view of a shell mold wall showing the randomly oriented discontinuous stucco fibers applied on a still wet refractory slurry layer and after the stucco fibers are packed down to form a generally two dimensional mat.

The stucco layer(s) formed pursuant to the invention by applying granular stucco particles 15 on the randomly oriented discontinuous stucco fibers 14 of FIG. 2B exhibit less porosity for a given shell mold wall thickness and less fiber-bridging (where fibers bridge across one another creating a void) than a stucco layer comprising only discontinuous stucco fibers. Application of the granular stucco fibers rearranges the randomly oriented discontinuous stucco fibers to provide a higher fiber packing density with some granular stucco particles 15 filling spaces between the stucco fibers 14 and a more dense shell mold wall 25, compare FIGS. 3 and 4.

Shell molds pursuant to the invention exhibit greater strength in tension and greater toughness (resistance to crack propagation) than shell molds without one or more of the composite slurry layers (comprising the discontinuous stucco fibers 14 and granular stucco particles 15) and are advantageous to resist mold splitting during the pattern removal operation.

The following Examples are offered to further illustrate the invention without limiting it.

EXAMPLES

Example 1

Shell molds were made by the lost wax process described in U.S. Pat. No. 4,966,225 by applying to identical wax patterns ceramic slurry layers/stucco layers as shown in Table I below:

TABLE I

| | Sample A (w/o fiber) | | Sample B (w/o stucco packing) | | Sample C (w/ stucco packing) | |
|---|---|---|---|---|---|---|
| | Slurry | Stucco | Slurry | Stucco | Slurry | Stucco |
| 1st | A | −120 Alumina | A | −120 Alumina | A | −120 Alumina |
| 2nd | B/C | −90 Alumina | B/C | −90 Alumina | B/C | −90 Alumina |
| 3rd | B/C | 28 × 48 Tab Alumina | B/C | 28 × 48 Tab Alumina | B/C | 28 × 48 Tab Alumina |
| 4th | B/C | 14 × 28 Tab Alumina | B/C | ¼" Q Fiber | B/C | ¼" Q Fiber + 14 × 28 Tab Alumina |
| 5th | C | 14 × 28 Tab Alumina | C | ¼" Q Fiber | C | ¼" Q Fiber + 14 × 28 Tab Alumina |
| 6th | C | 14 × 28 Tab Alumina | C | ¼" Q Fiber | C | ¼" Q Fiber + 14 × 28 Tab Alumina |
| 7th | C | 14 × 28 Tab Alumina | C | 14 × 28 Tab Alumina | C | 14 × 28 Tab Alumina |
| 8th | C | 14 × 28 Tab Alumina | C | 14 × 28 Tab Alumina | C | 14 × 28 Tab Alumina |
| 9th | C | | C | | C | |

It is apparent from the Table that the ceramic slurries and stuccoes of the 1st (facecoat), 2nd, 3rd, 7th, and 8th layers were the same. Slurry A comprised an alumina-based slurry using a 12 nm size colloidal silica binder liquid (LUDOX HS30 binder from Grace Chemicals Corp.). Slurries B, C and D each comprised a zircon-based slurry using the 12 nm size colloidal silica binder liquid. Dips using two slurries are designated B/C (and B/D in later examples) and represent the well known practice of initially dipping in a low viscosity slurry followed by dipping in a standard, higher viscosity slurry. The stucco for the 1st stucco layer was −120 mesh fused alumina granular stucco (−120 mesh meaning less than −120 mesh particles). The stucco for the 2nd stucco layer was −90 mesh fused alumina granular stucco. The stucco for the 3rd stucco layer was 28×48 mesh tabular alumina granular stucco where the stucco particles have a particle size less than 28 mesh and greater than 48 mesh. The stucco for the remaining layers was 14×28 mesh tabular alumina granular stucco. As is apparent, the ceramic slurry used for the 4th, 5th, and 6th layers also were the same. However, 4th, 5th, and 6th stucco layers were different in that in making mold sample A, the 4th, 5th, and 6th stucco layers comprised only 14×28 tabular alumina, wherein in making mold sample B, the 4th, 5th, and 6th stucco layers comprised only ¼ inch long chopped (discontinuous) "Q" fibers. In making mold sample C, the 4th, 5th, and 6th stucco layers comprised the ¼ inch long chopped "Q" fibers followed by application of granular 14×28 stucco particles for fiber stucco packing pursuant to the invention.

The discontinuous chopped "Q" fibers comprised silica and had a diameter in the range of 9 to 14 microns. The unchopped "Q" fibers (Quartzel silica) are available from Saint-Gobain Quartz, 1600 W. Lee St., Louisville, Ky. The "Q" fibers were chopped by OMNIA LLC, Raleigh, N.C. The 14×28 granular stucco particles comprised grains having a particle size of less than 28 mesh and greater than 48 mesh and comprised tabular alumina. The 14×28 alumina granular stucco particles are available from Alcoa Alumina and Chemicals, Bauxite, Ark. Mesh sizes are with respect to U.S. standard screen system. In making the mold samples, both the "Q" stucco fibers and 14×28 alumina granular stucco particles were applied to the pattern by free fall from 5 feet above the pattern as each mold sample was being built-up.

Figure 3:
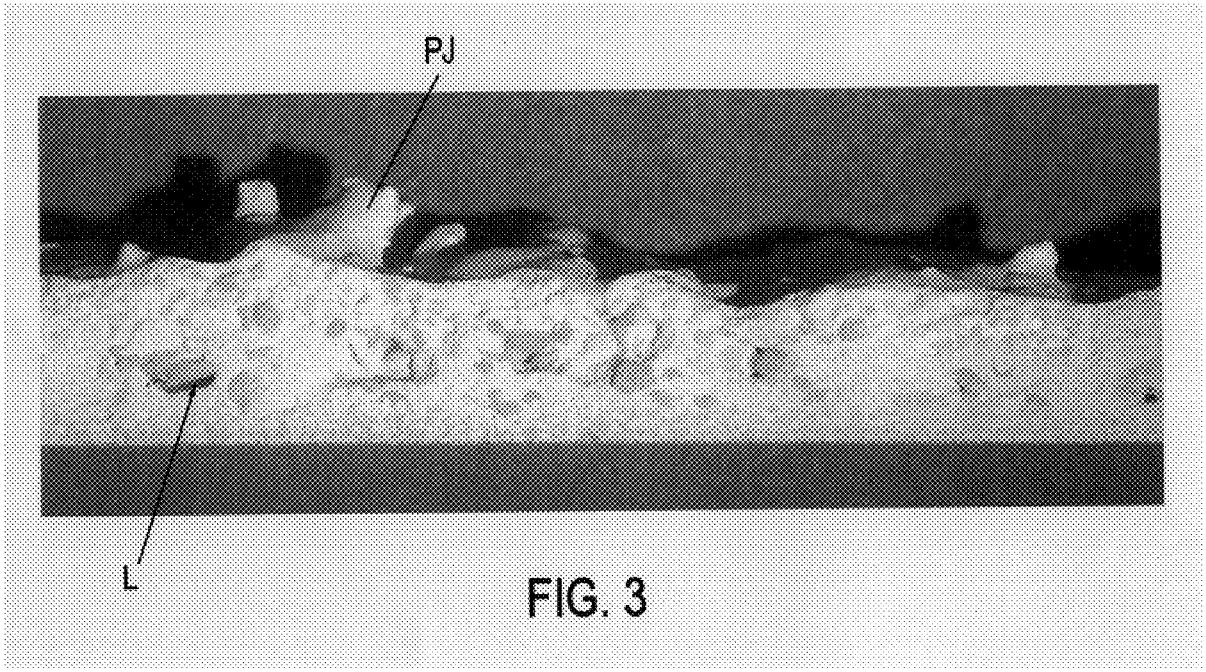
FIG. 3 is a photograph of a sectioned shell mold made without granular stucco particles on the discontinuous stucco fibers.
Figure 4:
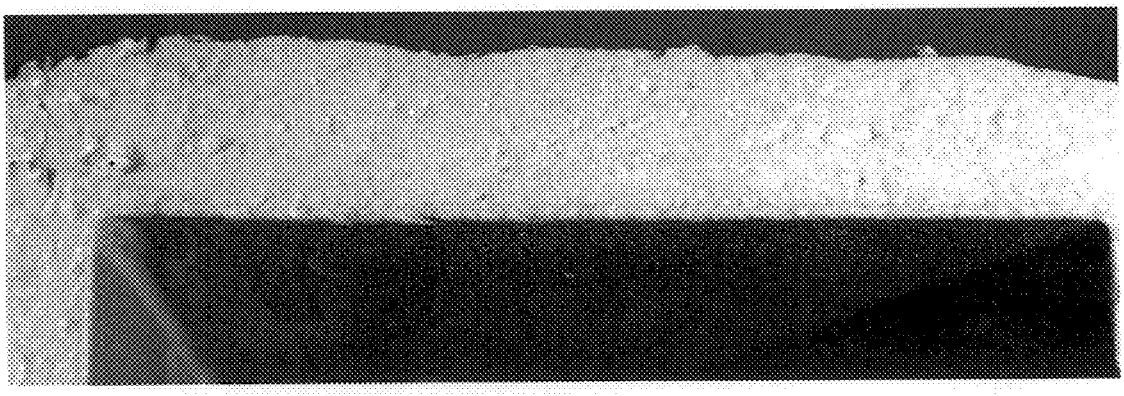
FIG. 4 is a photograph of a sectioned shell mold wall made pursuant to a preferred method of the invention.

FIGS. 3 and 4 are photographs of the built-up wall of shell mold sample B and C, respectively. The difference between shell mold B and C is dramatic in that the mold sample C exhibits less porosity for a given shell mold wall thickness and less fiber-bridging (where fibers bridge across one another creating a void) Random orientation of the stucco fibers and fiber-bridging are apparent in sample B in FIG. 3, both of which increase wall porosity and the number of void defects in the mold wall, reducing mold strength. For example, the projections PJ on the outer mold sample surface (left hand side of FIG. 3) are discontinuous stucco "Q" fibers oriented outwardly and transversely of the plane of the sample wall. Several large voids L are apparent and associated with the discontinuous stucco fibers. In FIG. 4, application of the granular stucco particles has rearranged the discontinuous stucco fibers to provide a higher fiber packing density with granular stucco particles filling spaces between the stucco fibers to produce a more dense and stronger shell mold wall.

Mechanical properties were determined for mold samples A, B and C and are set forth in Table II below:

TABLE II

| | Sample A | Sample B | Sample C |
|---|---|---|---|
| MOR (Psi) | 830 | 657 | 900 |
| EBP | 0.059 | 0.253 | 0.307 |
| Shell Porosity (%) | 20.4 | 28.5 | 23.6 |

As the results show, mold sample C retained similar strength and porosity as sample A with improved EBP (EBP is energy to break point expressed in units of lbf-in). Sample B, however, became weaker and more porous due to fiber bridging. The overall mechanical properties of sample C pursuant to the invention are improved significantly, so that cracking probability of the shell mold should be reduced.

Example 2

Figure 5:
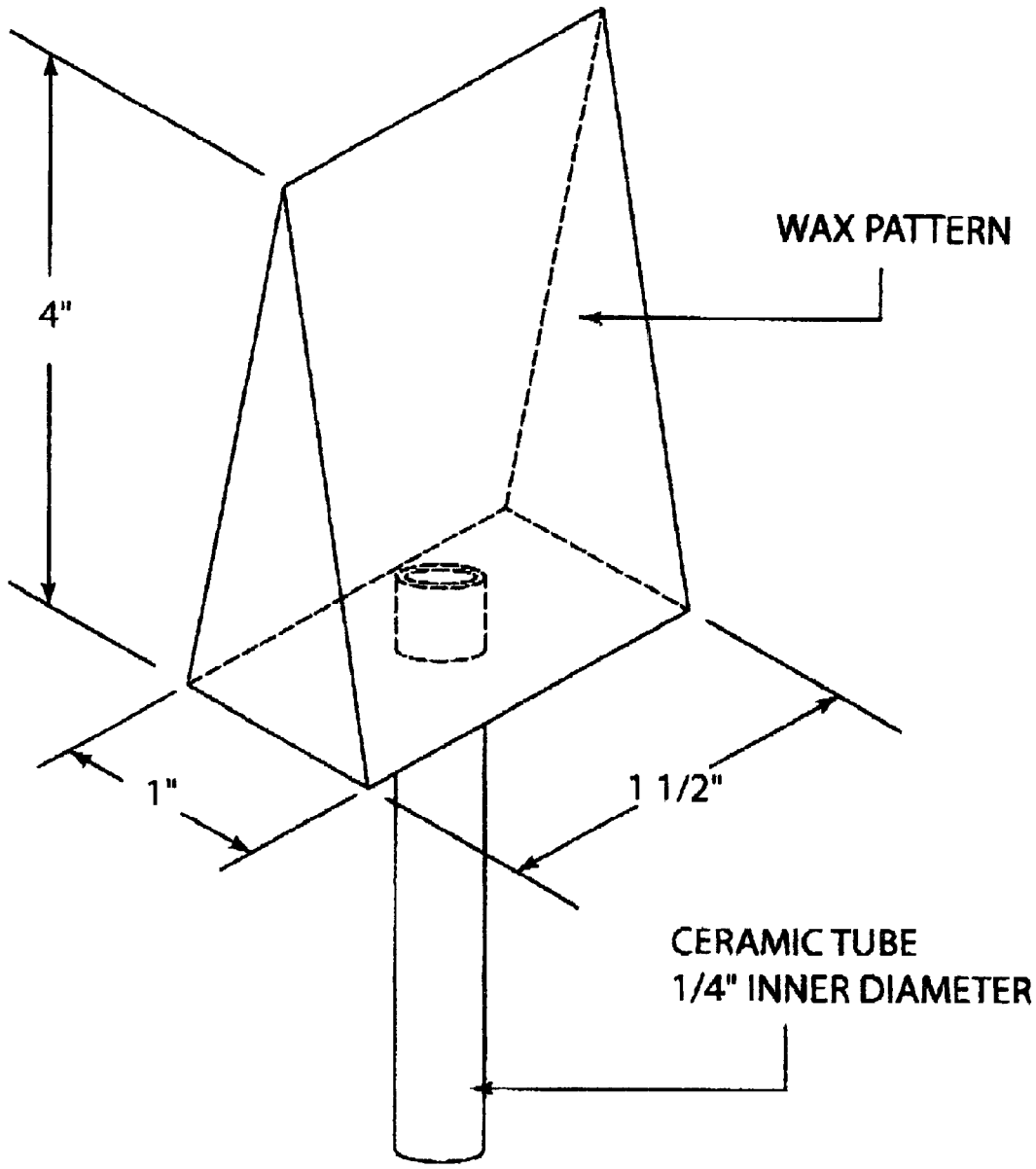
FIG. 5 is a perspective view of a wedge shaped pattern used to make a shell mold for pattern removal trials.

This example describes how shell mold performance during pattern removal can be improved by practice of the invention. A wedge shaped wax pattern, FIG. 5, was used to test the probability of shell mold cracking. This wedge shaped pattern can often cause shell mold cracking along the edges of the wedge.

Test wedge shaped shell molds were made as shown in Tables III below. Slurry A and B were equivalent to slurry A and B in Example 1. Slurry D was similar to slurry C in Example 1 with a higher organic binder content. Some wedge shaped molds A1, B1, C1 were made with no fiber reinforcement, and the other set A2, B2, C2 was made with "Q" fiber reinforcement followed by application on the fibers of 14×28 tabular alumina stucco (designated 14–28 in Table III) pursuant to the invention and as described in Example 1. After steam dewaxing operation, each wedge shaped mold was inspected, and the probability of cracking was calculated based on percentage of cracked wedge shaped molds out of the total shell molds.

TABLE III

| Dip | Slurry | Stucco size | Dip | Slurry | Stucco |
|---|---|---|---|---|---|
| Wedge Specimen A1 (9-layer shell) | | | Wedge Specimen A2 (9-layer shell) | | |
| 1st | A | 120 | 1st | A | 120 |
| 2nd | B/D | 90 | 2nd | B/D | 90 |
| 3rd | B/D | 28–48 | 3rd | B/D | 28–48 |
| 4th | D | 14–28 | 4th | D | ¼" Q-fiber, 14–28 |
| 5th | D | 14–28 | 5th | D | 14–28 |
| 6th | D | 14–28 | 6th | D | 14–28 |
| 7th | D | 14–28 | 7th | D | ¼" Q-fiber, 14–28 |
| 8th | D | 14–28 | 8th | D | 14–28 |
| 9th | D | | | D | |
| Wedge Specimen B1 (8-layer shell) | | | Wedge Specimen B2 (8-layer shell) | | |
| 1st | A | 120 | 1st | A | 120 |
| 2nd | B/D | 90 | 2nd | B/D | 90 |
| 3rd | B/D | 28–48 | 3rd | B/D | 28–48 |
| 4th | D | 14–28 | 4th | D | ¼" Q-fiber, 14–28 |
| 5th | D | 14–28 | 5th | D | 14–28 |
| 6th | D | 14–28 | 6th | D | ¼" Q-fiber, 14–28 |
| 7th | D | 14–28 | 7th | D | 14–28 |
| 8th | D | | 8th | D | |

TABLE III-continued

| Dip | Slurry | Stucco size | Dip | Slurry | Stucco |
|---|---|---|---|---|---|
| Wedge Specimen C1 (7-layer shell) | | | Wedge Specimen C2 (7-layer shell) | | |
| 1st | A | 120 | 1st | A | 120 |
| 2nd | B/D | 90 | 2nd | B/D | 90 |
| 3rd | B/D | 28–48 | 3rd | B/D | 28–48 |
| 4th | D | 14–28 | 4th | D | ¼" Q-fiber, 14–28 |
| 5th | D | 14–28 | 5th | D | ¼" Q-fiber, 14–28 |
| 6th | D | 14–28 | 6th | D | 14–28 |
| 7th | D | | 7th | D | |

wherein "28–48" and "14–28" in Tables III correspond to 28×48 and 14×28 mesh size granular stucco in Table I.

Wedge shaped shell mold specimens A1–C2 were placed in a steam autoclave to remove the wax pattern. After steam dewaxing operation, each wedge shaped mold was inspected, and the probability of cracking (prob. cracking) was calculated based on percentage of cracked wedge shaped molds out of the total shell molds and listed in Table IV below.

TABLE IV

| Wedge Specimen | prob. Cracking (%) |
|---|---|
| A1 | 100 |
| A2 | 0 |
| B1 | 100 |
| B2 | 0 |
| C1 | 100 |
| C2 | 0 |

Under steam autoclave dewaxing conditions, the Q fiber-reinforced shell molds A2, B2, C2 showed no cracking for any of the molds tested, whereas all of the standard (non-Q fiber reinforced) shell molds A1, B1, C1 were cracked. Mold sample C2 with only 7 layers including 2 Q fiber layers had no cracks as compared with the thicker 9-layer mold sample A1 with 100% cracking probability. Dewaxing performance of the shell molds produced pursuant to the invention is substantially improved.

The above sample shell molds also were subjected to furnace dewaxing where a furnace was first heated to 1600 degrees F. Then, the wedge shaped sample shell molds were pushed into the furnace to remove the wax pattern and then inspected after removal from the furnace. The probability of cracking (prob. cracking) for each sample shell mold was calculated and listed in Table V below:.

TABLE V

| Wedge Specimen | prob. Cracking (%) |
|---|---|
| A1 | 0 |
| A2 | 0 |
| B1 | 100 |
| B2 | 0 |
| C1 | 100 |
| C2 | 25 |

Under the flash dewax conditions of the heated furnace, the experimental results demonstrated significant reductions of shell mold cracking by practice of the invention. For example, the 8-layer shell mold with Q fiber reinforcement (sample B2) had no cracking, while the standard shell molds without Q fiber reinforcement (sample B1) were all cracked.

Although the present invention has been described with respect to certain specific illustrative embodiments thereof, it is not so limited and can be modified and changed within the spirit and scope of the invention as set forth in the appended claims.

I claim:

1. A method of making a ceramic shell mold, comprising repeatedly coating a fugitive pattern of an article to be cast with a ceramic slurry layer and applying on the ceramic slurry layer a refractory stucco to form a plurality of ceramic slurry layers and stucco layers on the pattern wherein at least one of the stucco layers is formed by applying discontinuous stucco fibers followed by applying granular stucco particles on the discontinuous stucco fibers.

2. The method of claim 1 wherein the granular stucco particles are applied on randomly oriented discontinuous stucco fibers to pack the discontinuous stucco fibers down on the slurry layer underlying the discontinuous stucco fibers.

3. The method of claim 2 wherein the granular stucco particles are applied on the randomly oriented discontinuous stucco fibers while the underlying slurry layer is still wet such that a majority of the packed down discontinuous stucco fibers stick to the underlying slurry layer.

4. The method of claim 2 wherein the granular stucco particles are applied on the randomly oriented discontinuous stucco fibers to form a stucco layer comprising packed down discontinuous stucco fibers and the granular stucco particles.

5. The method of claim 4 wherein some of the granular stucco particles fill spaces between the packed down discontinuous stucco fibers.

6. The method of claim 1 wherein the granular stucco particles are applied by raining the granular stucco particles by gravity down on the discontinuous stucco fibers.

7. The method of claim 6 wherein the discontinuous stucco fibers and the granular stucco particles comprise the same or different ceramic material.

* * * * *